US005667465A

United States Patent [19]

McCollum et al.

[11] Patent Number: 5,667,465

[45] Date of Patent: Sep. 16, 1997

[54] MULTIDIRECTIONAL CAM

[75] Inventors: Robert McCollum, Transfer; Gregory T. Telesz, Volant; Jerry K. Liepheimer, Jamestown, all of Pa.

[73] Assignee: Trotter, Inc., Medway, Mass.

[21] Appl. No.: 384,917

[22] Filed: Feb. 7, 1995

[51] Int. Cl.[6] ..... A63B 21/062

[52] U.S. Cl. ..... 482/100; 482/137

[58] Field of Search ..... 482/92, 93, 96, 482/97, 98, 99, 100, 101, 102, 103, 135, 136, 137, 138, 139

[56] References Cited

U.S. PATENT DOCUMENTS 4,456,245 6/1984 Baldwin ..... 482/136
5,102,121 4/1992 Solow et al. ..... 482/94
5,308,304 5/1994 Habing ..... 482/137

*Primary Examiner*—Richard J. Apley
*Assistant Examiner*—William La Marca

[57] ABSTRACT

Apparatus for performing weight resistance exercise via manual rotation, the apparatus comprising: a rotatable member mounted on an axle, the axle being manually engageable for application of manual force to rotate the rotatable member; a pair of cable stops each connected to an end of a respective cable which is interconnected to a weight, the weight through the cable holding the stops within a respective mounting aperture; the rotatable member having a pair of retaining members, each retaining member receiving and retaining a respective stop member upon rotation of the rotatable member; the cable being interconnected to the weight such that rotation of the rotatable member is resisted by the weight through the cable upon application of manual rotating force to the axle.

18 Claims, 6 Drawing Sheets

MULTIDIRECTIONAL CAM

BACKGROUND OF THE INVENTION

The present invention relates to exercise machines and more particularly to an exercise apparatus having a rotatable member mounted on an axle which is connected to a manually engageable lever. Rotatable heart-shaped discs have been used in the past in weight lifting apparati for linking the eye of the heart to a weight stack with a cable. The nature of the linkage between the heart of the disc and the weight stack is such that there is an inherent looseness or play in the rotation of the disc before the weight stack is fully engaged to resist rotation of the disc.

SUMMARY OF THE INVENTION

It is an object of the invention to provide an exercise apparatus having a novel rotatable member which is engageable by application of manual force which will rotate the rotatable element against a resistant weight force where the rotatable element is held firmly in an initial position and is immediately resisted by a weight force upon rotation of the element.

It is a further object of the invention to provide an exercise apparatus having a novel weight resistant rotatable member having a cammed surface for reliably guiding a cable linked between the rotatable element and a weight stack along a predetermined path which defines a selected rate at which the weight force is resisted by rotation of the rotatable member per unit of rotation.

In accordance with the invention therefore, there is provided an apparatus for performing weight resistance exercise via manual rotation, the apparatus comprising a rotatable member mounted on an axle, the axle being manually engageable for application of manual force to rotate the rotatable member; a pair of cable stop members each connected to an end of a respective cable which is interconnected to a weight force, the weight force through the cable holding the stop members within a respective mounting aperture; the rotatable member having a pair of retaining members, each retaining member receiving and retaining a respective stop member upon rotation of the rotatable member; the cable being interconnected to the weight force such that rotation of the rotatable member is resisted by the weight through the cable upon application of manual rotating force to the axle.

The rotatable member has an initial stable position when manual force is not being applied to the axle, the rotatable member being mounted on the apparatus such that both stop members are simultaneously received and retained within the retaining members when the rotatable member is in the initial stable position.

The rotatable member is mounted such that one stop member is received and retained within a respective retaining member and another stop member is held within a respective mounting aperture which is stationarily connected to a frame of the apparatus upon application of rotating force to the axle.

The rotatable member preferably has a grooved circumferential surface for receiving one of the respective cable means upon rotation of the rotatable member.

Each of the stop members may be respectively connected to opposite ends of a single cable, the single cable being interconnected to the weight force through a pulley mechanism.

The mounting apertures are preferably disposed within a respective structural member stationarily connected to the apparatus, one of the cable stop members being pulled into a respective aperture of a respective structural member under force of the weight mechanism upon rotation of the rotatable member, the respective structural member resisting the force of the weight mechanism.

The mounting apertures preferably comprise a slot and the stop members preferably comprise a rigid bar extending the length of the slot, the receiving and retaining members of the rotatable member being adapted to receive a respective bar with the bar being simultaneously received within a respective mounting aperture when the rotatable member is in the initial stable position.

The cables are preferably interconnected to the weight stack through one or more pulleys. The cables are preferably interconnected to the weight stack such that there is little or no slack or looseness in the cables at any time, in particular, when the rotatable member is in its initial no-load position. Thus, when the rotatable member is initially rotated beginning from its initial no-force, stable position, rotation out of the initial position is immediately resisted by the force of the weight stack.

In a preferred embodiment, each stop member is respectively connected to the opposite end of a single unitary cable, the intermediate portion of the cable being engaged around one pulley of a dual pulley mechanism. A second cable is engaged around the other pulley of the dual pulley mechanism with one end of the second cable being connected to the weight stack and another end of the second cable being connected to an immovable ground position.

BRIEF DESCRIPTION OF THE DRAWINGS

The invention is described in detail below with reference to one exemplary embodiment shown in the accompanying figures wherein.

DETAILED DESCRIPTION OF INVENTION

Figure 2:
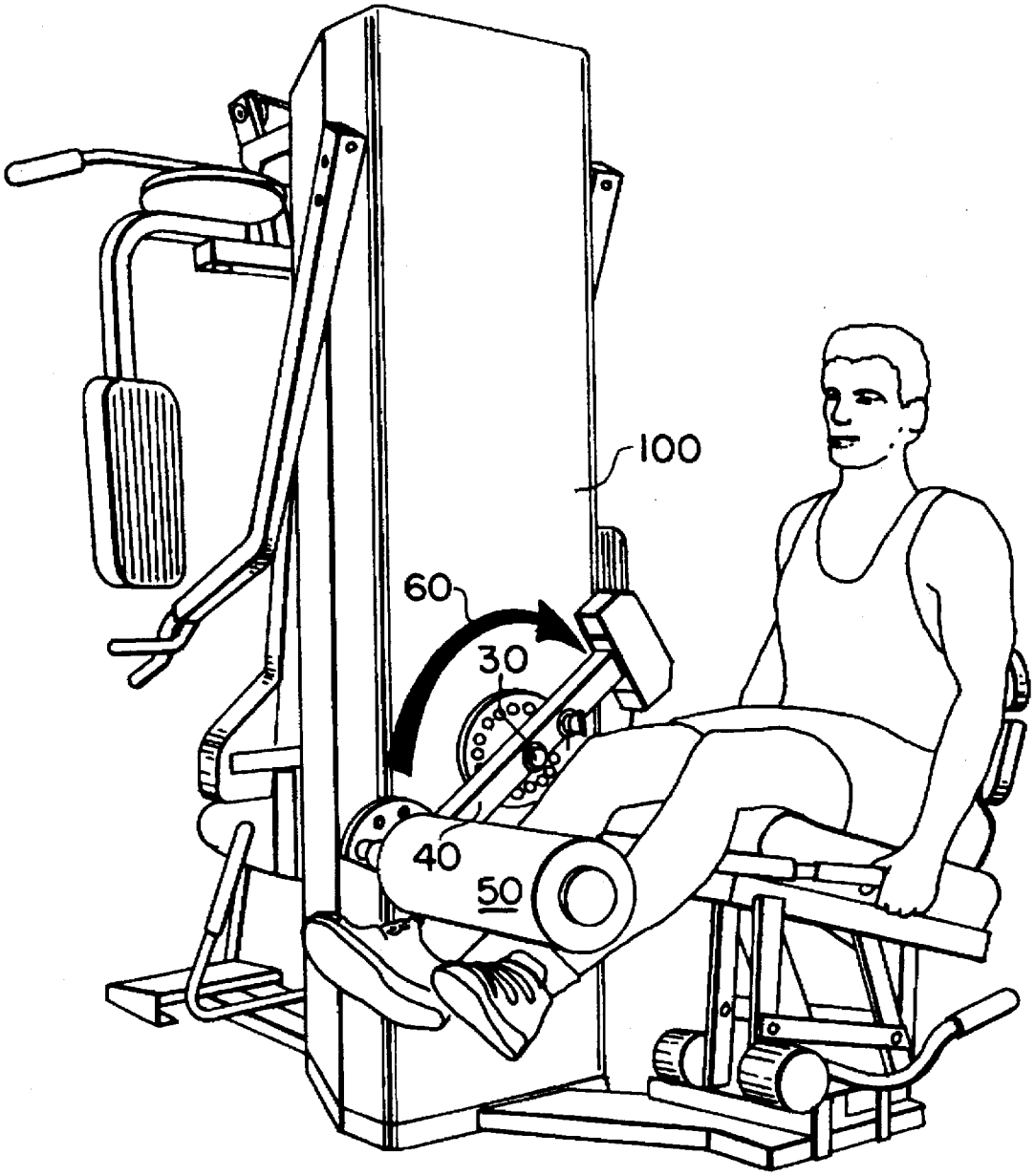
FIG. 2 is an isometric view similar to FIG. 1 showing the user applying a leg force opposite to that shown in FIG. 1.
Figure 3:
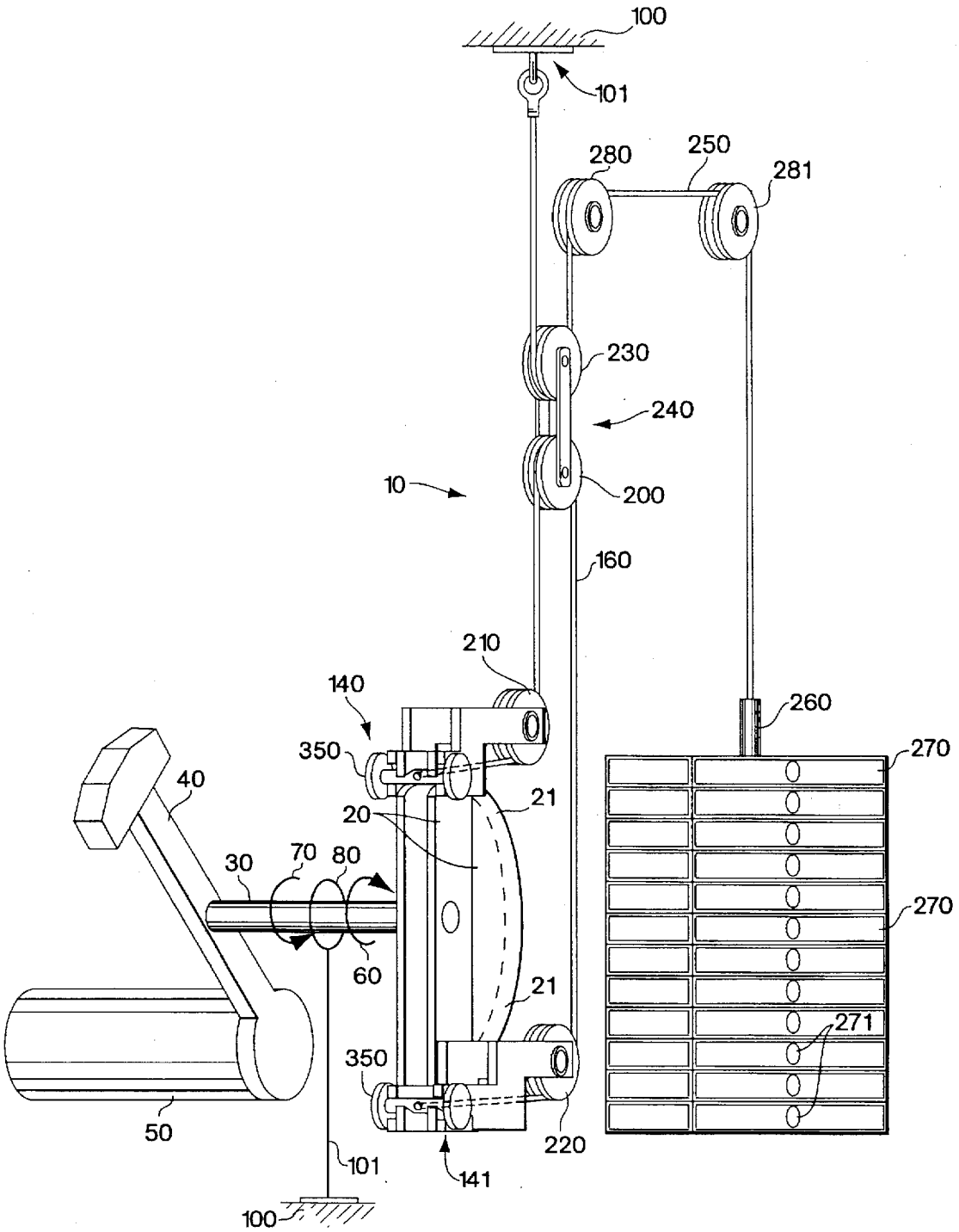
FIG. 3 is a schematic isometric view of an apparatus according to the invention showing the rotatable member in an initial zero-force position.

FIG. 3 shows a schematic view of a multi-directionally rotatable weight exercising apparatus 10 according to the invention. The apparatus 10 comprises a rotatable disc member 20 connected to an axle 30 which is in turn connected to a lever 40 having a transverse extension 50 for allowing a user to conveniently apply a directionally rotating force to the axle in either a clockwise 60 or counterclockwise 70 direction as for example shown in FIGS. 1, 2. The axle 30 is mounted in a conventional manner on a stationary superstructure or frame 100, 101 of the machine for rotation around its axis such as via a bearing mechanism 80.

Figure 4:
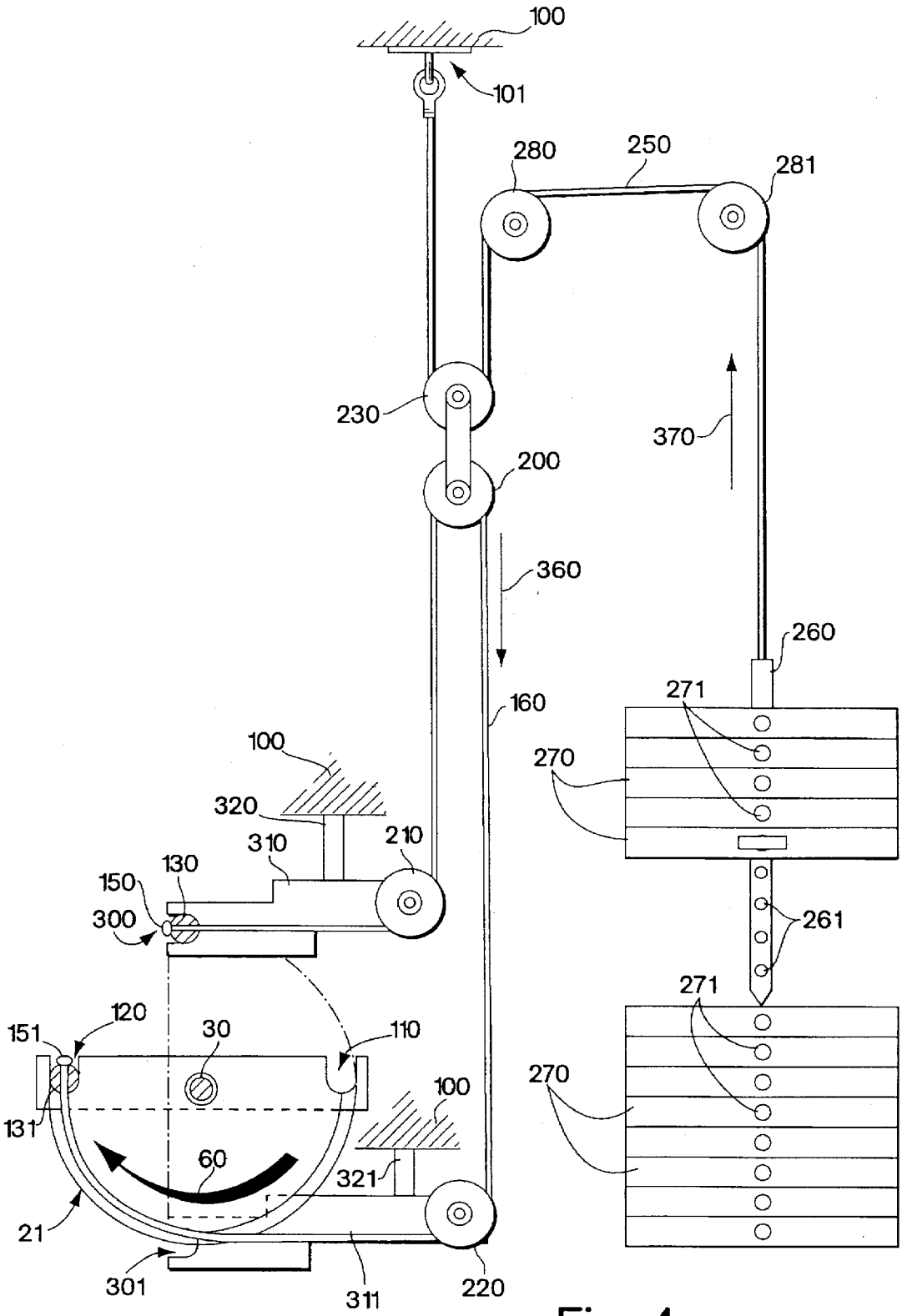
FIG. 4 is a schematic frontal view of the apparatus shown in FIG. 3 showing the rotatable member rotated 90 degrees clockwise from its zero position.
Figure 5:
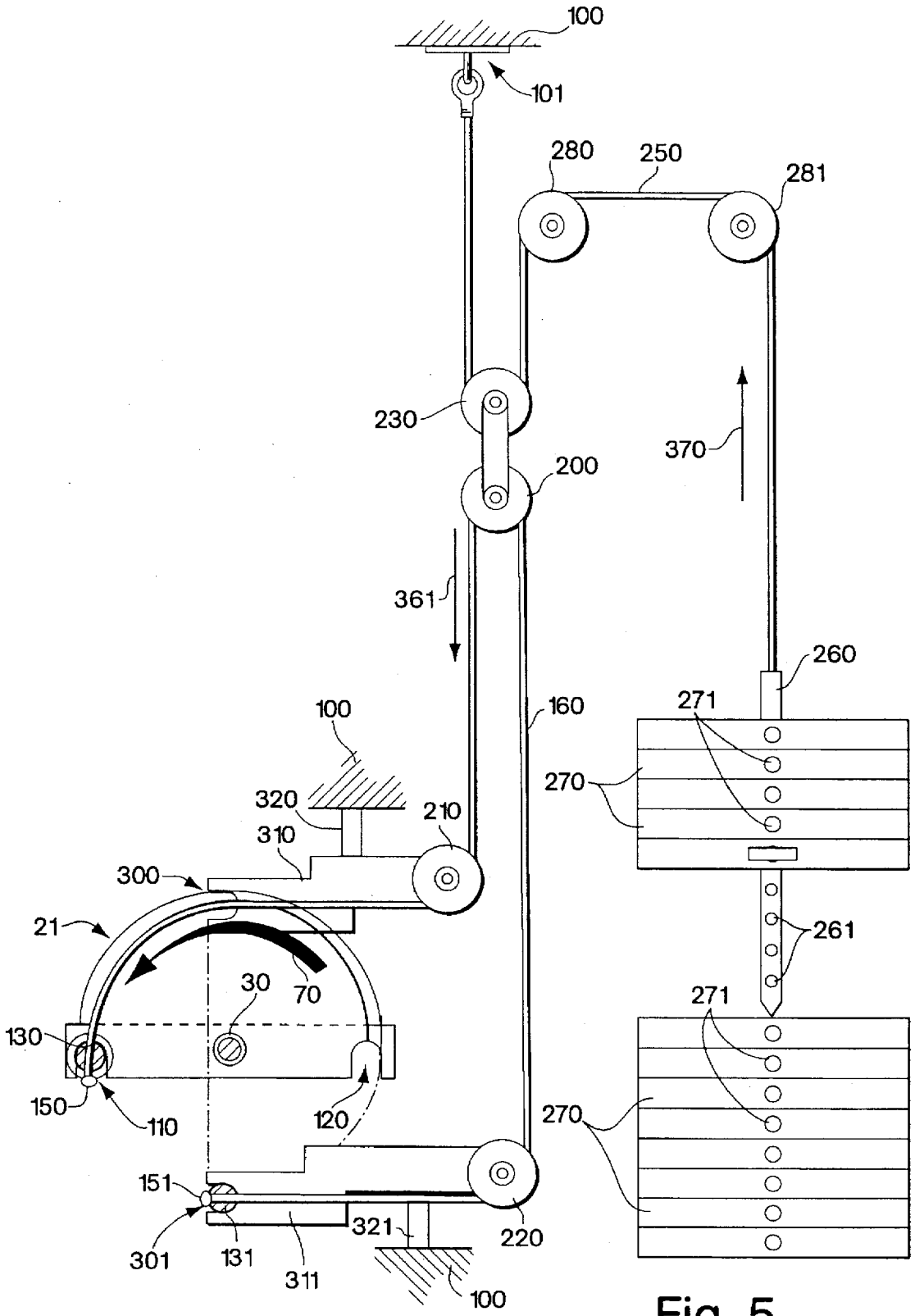
FIG. 5 is a frontal view of the apparatus shown in FIG. 3 showing the rotatable member rotated 90 degrees counterclockwise from its FIG. 3 zero position.

The rotatable member 20 has a pair of slots 110, 120 disposed at separate predetermined positions around the periphery of the rotatable member 20 as shown in FIGS. 4, 5. The slots 110, 120 are adapted to receive the shaft portion 130, 131 of a respective bar bell 140, 141, FIGS. 3–7 which act as a stop on the ends of the cable 160. The bar bells 140–141 are connected to the opposite ends 150, 151 of the single, unitary cable 160. The cable 160 is engaged around the circumferential groove of a series of pulleys 200, 210, 220 as shown in FIGS. 3–7. Pulley 200 is one of a pair of pulleys 200, 230 mounted on an independent pulley subassembly mechanism 240. A second cable 250 is attached at one end to an immovable point 101 which is connected to the superstructure/frame 100 of machine 10 and the other end of the cable 250 is attached to a rod manifold 260 which is adapted to allow the user to connect a selected number of weight bars 270 thereto. As shown in FIG. 3, the rotatable member 20 is in its initial, no-force-applied stable or zero position where the weight stack 270 is undisturbed.

As shown in FIGS. 3–5, the second cable 250 is engaged around the grooved circumference of pulley 230 and additional guide pulleys 280, 281. The length of the cables 160 and 250 are selected such that when the rotatable member 20 is in its initial stable position as shown in FIG. 3, there is little or no slack or looseness in the cables 160, 250. Such an arrangement enables the holding of the shafts 130, 131 of both stops 140, 141 within respective receiving slots 300, 301 which are provided in a pair of stationary arms 310, 311 which are connected by conventional mechanisms 320, 321 to the immovable superstructure/frame 100 of the machine 10, FIGS. 4–7.

The lengths of the cables 160, 250 may be selected such that the shafts 130, 131 of stops 140, 141 are simply held within slots 300, 301 or such that the stops 140, 141 are held under tension within slots 300, 301, e.g. by selecting the lengths of the cables 160, 250 to be short enough such that one or more of the weight elements 270 is always engaged with the manifold 260 and exerting a pulling force on cable 250 even when the rotatable member 20 is in the zero, no-force position of FIG. 3.

As shown in FIGS. 4, 5, the manifold 260 comprises a rod 260 which is received through a complementary aligned apertures (not shown) extending through the depth of each weight element 270. The rod 260 has a plurality of axially aligned apertures 261 which are spaced along the length of the rod 260 so as to coincide/align with a complementary horizontal aperture 271 provided in each weight element 270, FIG. 4. The user may select as many weight elements 270 to be engaged with the rod 260 as desired by inserting a pin (not shown) through a selected aperture 271 far enough to fully penetrate a complementary rod aperture 261 when the weight stack is in the zero position of FIG. 3.

The operation of the apparatus is shown by the Figures. In the zero position of the apparatus shown in FIGS. 3, 6 no force is being applied to lever 40. In this position, the shafts 130, 131 of the stops 140, 141 are being held within their respective receiving slots 300, 301 on the ends of stationary arms 310, 311. At the same time, the shafts 130, 131 are also disposed within the retaining slots 110, 120 of the rotatable member 20. As shown in the FIGS. 3–7 embodiment, the stops 140, 141 include head members 350 having a diameter wider than the width of slots 110, 120, 310, 311 such that the shafts 130, 131 cannot slide axially out of the slots. A mentioned above, the stops 140, 141 are held within the slots 110, 120 by selecting the lengths of cables 160, 250 such that there is little or no slack therein.

Upon a clockwise rotation 60, FIG. 4, of the rotatable member 20, e.g. by the leg force action shown in FIG. 2, the slot 120 in member 20 pulls the shaft 131 of stop 141, FIG. 4, out of the receiving slot 301 in arm 311 and the cable 160 is pulled downwardly 360, FIG. 4, causing the cable 250 to pull upwardly 370 on the manifold 260 and the selected number of engaged weight elements 270, FIG. 4. As the slot 120 pulls the stop shaft 131 from the zero position, FIG. 3, through an arc as for example shown in FIG. 4 (90 degrees), a certain length of the cable extending from end 151 backwardly along the cable wraps around and is guided into a groove on the circumferential surface of the member 30. During this clockwise movement, the other stop mechanism 130, 140 remains within the slot 300 in stationary arm 310 and is held therein under the tension created in cable 160 by the resistant weight force of elements 270 which are being lifted 370.

Figure 1:
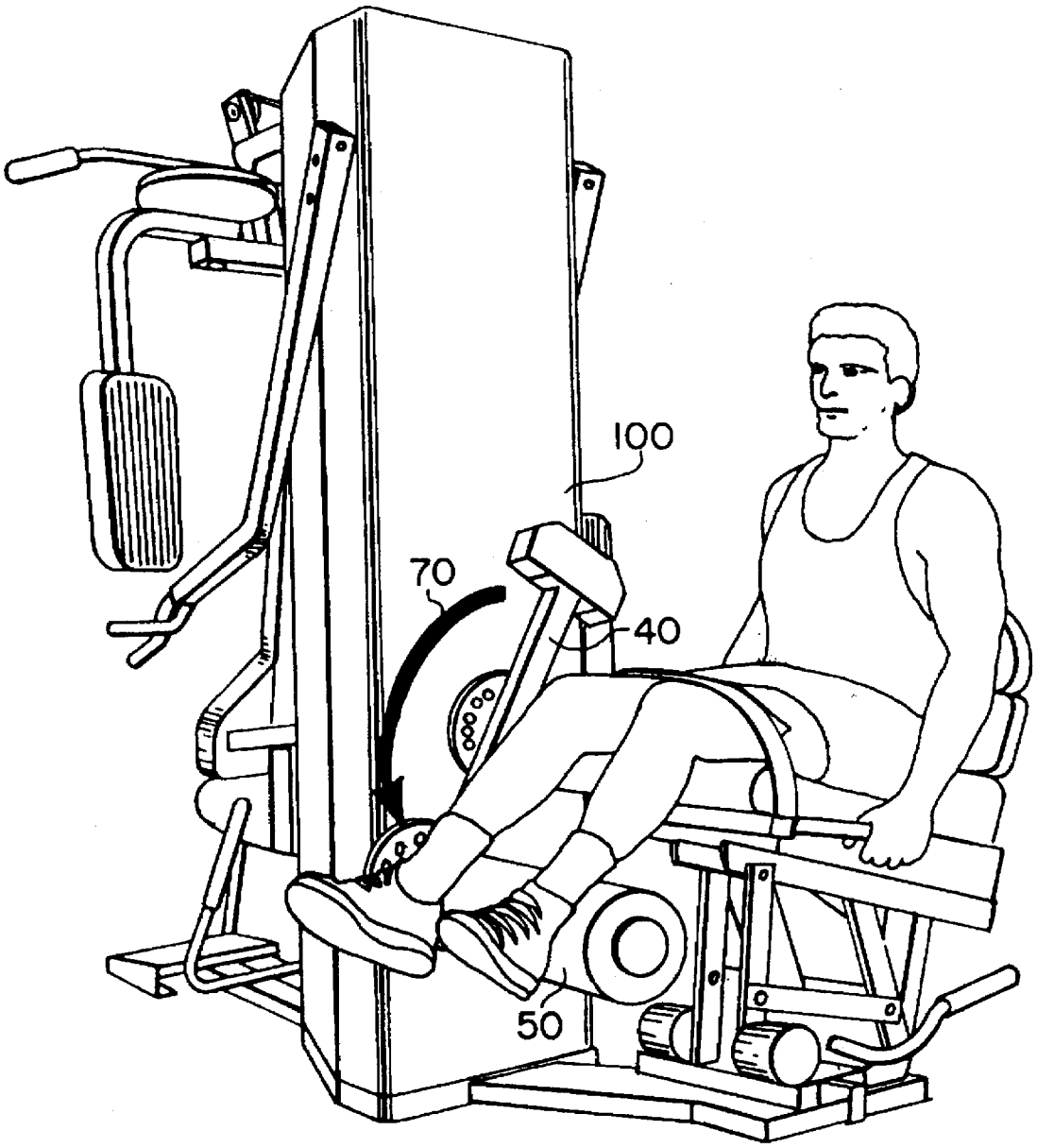
FIG. 1 is an isometric view of an exercise machine showing a user in position at a station of the machine applying manual leg force in one direction to a lever connected to the rotatable member of the apparatus of the invention.
Figure 7:
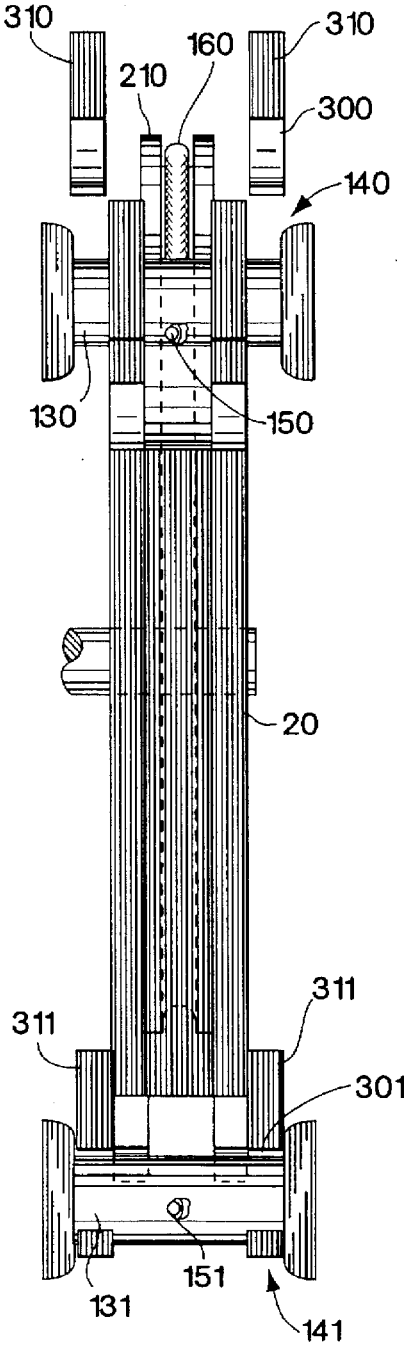
FIG. 7 is a schematic view similar to FIG. 6 where the rotatable element is rotated about 30 degrees counterclockwise.

Upon a counterclockwise rotation 70, FIG. 5, FIG. 1, the converse operation occurs as described with reference to FIG. 4. Slot 110 removes stop 130, 140 from slot 300 in an arcuate fashion and the cable 160 is again pulled downwardly 361 pulling on cable 250 to lift 370 rod 260 and its engaged weight elements 270 upwardly. A certain length of cable 160 extending backwardly from end 150 is guided into a groove on the circumferential surface of the member 20. Stop 131 remains held within slot 301 of stationary arm 311 under the tension in cable 160 created by the upward pulling 370 of weight stacks 270 which are engaged with rod 260. FIG. 7 shows a radially directed view of the apparatus where the rotatable member 20 has been rotated counterclockwise by about 30 degrees. As shown in FIG. 7, the stop 130, 140 has been pulled out of arm slot 300 and is retained in rotatable member slot 110 under tension of cable 160. Also as shown in FIG. 7, the other stop 131, 141 is simultaneously retained in arm slot 301.

Figure 6:
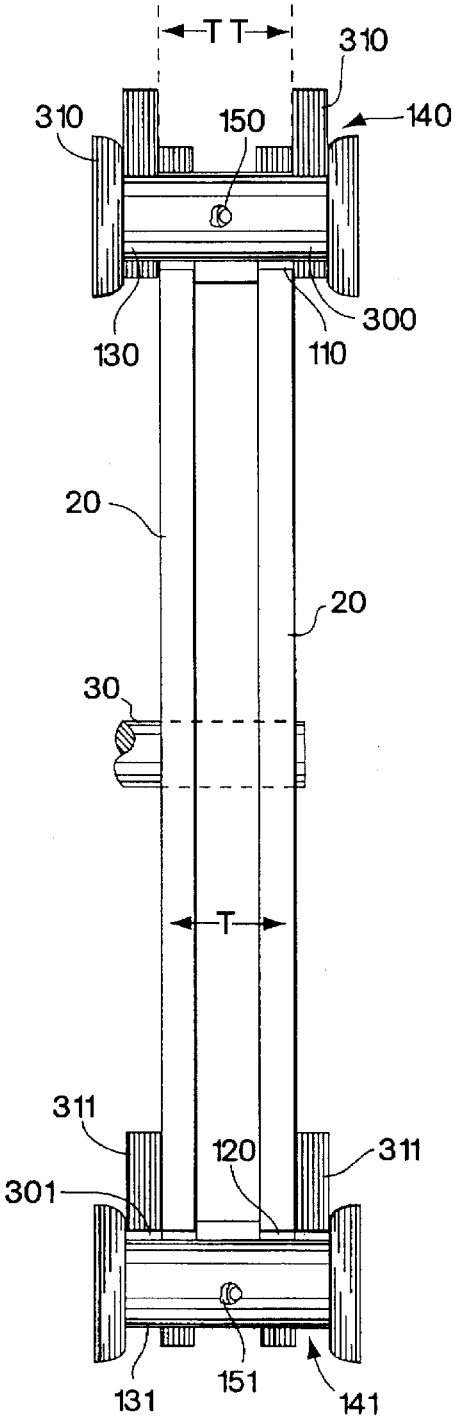
FIG. 6 is a schematic view along lines 6—6 of FIG. 3.

As shown in FIGS. 6, 7 the arm slots 300, 301 and the rotatable member slots 110, 120 are configured so as to be able to simultaneously receive the shaft portions 130, 131 of the stops 140, 141 in the zero position of member 20. As shown in FIGS. 6, 7, the outside thickness T of the member 20 in which slots 300, 301 are disposed is less than or equal to the inside thickness TT of the spaced arm members 310 and 311 such that the rotatable member 20 can slide therethrough and allow the slots 110, 300 and 120, 301 to simultaneously receive shafts 130, 131.

In the particular exemplary embodiments shown and described herein, the contour of the outer circumference of the rotatable member 20 resembles the circumference of a circle. As can be readily imagined, the outer circumferential surface of the member 20 may have any desired contour along its length such as oval, square, hexagonal or the like. Such alternatively shaped contours may be selected depending on the rate of weight lifting per unit/degree of rotation desired. As can be readily imagined, the member 20 may be adapted to have a variety of alternative configurations other than a disc, e.g. a straight arm having stop receiving apertures or slots on either end thereof, a square or hexagonal plate or the like.

In the embodiment shown in FIGS. 3–7, pulleys 210, 220 are positioned so as to ensure that the cable 160 extending backwardly from ends 150, 151 is guided into the grooved cammed outer surface 21 of member 20 when rotated, FIGS. 4, 5, 7.

As can be readily imagined the specific arrangement of cables and pulleys interconnecting stops 140, 141 and rod 260 may be alternatively arranged. In any such alternative arrangement, the stops 140, 141 are always retained within at least one of slots 110 or 300 and one of slots 120 or 301 under tension of the weight elements 270 when the rotatable member is rotated.

It will now be apparent to those skilled in the art that other embodiments, improvements, details and uses can be made consistent with the letter and spirit of the foregoing disclosure and within the scope of this patent, which is limited only by the following claims, construed in accordance with the patent law, including the doctrine of equivalents.

What is claimed is:

1. Apparatus for performing weight resistance exercise via manual rotation, the apparatus comprising:

a rotatable member mounted on an axle, the rotatable member being manually engageable for application of manual force to rotate the rotatable member around the axle;

a pair of cable stop members each connected to an end of a respective cable means which is interconnected to a weight means, the weight means through the cable means holding the stop members within a respective mounting aperture;

the rotatable member having a pair of retaining members adapted to receive a respective stop member, one of the retaining members receiving and removing a respective stop member from its respective mounting aperture upon rotation of the rotatable member, the cable means being interconnected to the weight means such that rotation of the rotatable member is resisted by the weight means through the cable means upon application of manual rotating force to the axle.

2. The apparatus of claim 1 wherein the rotatable member has an initial stable position when manual force is not being applied to the axle, the rotatable member being mounted on the apparatus such that both stop members are simultaneously received and retained within the retaining members when the rotatable member is in the initial stable position.

3. The apparatus of claim 1 wherein the rotatable member is mounted such that one stop member is received and retained within a respective retaining member and another stop member is held within a respective mounting aperture stationarily connected to the apparatus upon application of rotating force to the axle.

4. The apparatus of claim 2 wherein the rotatable member is mounted such that one stop member is received and retained within a respective retaining member and another stop member is held within a respective mounting aperture stationarily connected to the apparatus upon application of rotating force to the axle.

5. The apparatus of claim 2 wherein the stop members are each received within a respective stationary mounting aperture when the rotatable member is in the initial stable position.

6. The apparatus of claim 1 wherein the rotatable member has a grooved circumferential surface for receiving one of the respective cable means upon rotation of the rotatable member.

7. The apparatus of claim 2 wherein the rotatable member has a grooved circumferential surface for receiving one of the respective cable means upon rotation of the rotatable member.

8. The apparatus of claim 5 wherein the rotatable member has a grooved circumferential surface for receiving one of the respective cable means upon rotation of the rotatable member.

9. The apparatus of claim 1 wherein the cable means are interconnected to the weight means through a pulley mechanism.

10. The apparatus of claim 1 wherein each of the stop members are respectively connected to opposite ends of a single cable, the single cable being interconnected to the weight means through a pulley mechanism.

11. The apparatus of claim 3 wherein the cable means are interconnected to the weight means through a pulley mechanism.

12. The apparatus of claim 3 wherein each of the stop members are respectively connected to opposite ends of a single cable, the single cable being interconnected to the weight means through a pulley mechanism.

13. The apparatus of claim 3 wherein the mounting apertures are disposed within a respective structural member stationarily connected to the apparatus, one of the cable stop members being pulled into a respective aperture of a respective structural member under force of the weight means upon rotation of the rotatable member, the respective structural member resisting the force of the weight means.

14. The apparatus of claim 3 wherein the mounting apertures comprise a slot and the stop members comprise a rigid bar extending the length of the slot, the receiving and retaining members of the rotatable member being adapted to receive a respective bar with the bar being simultaneously received within a respective mounting aperture when the rotatable member is in the initial zero position.

15. Apparatus for performing weight resistance exercise comprising:

a rotatable member manually engageable for application of manual force to rotate the rotatable member;

a pair of cable stop members, each comprising a bar and each connected to an end of a respective cable mechanism which is interconnected to a weight mechanism holding the stop members within a respective mounting aperture when the rotatable member is in an initial stable position;

the rotatable member having a pair of retaining members, each comprising a slot, wherein the rotatable member is mounted such that one stop member is received and retained within it's respective retaining member and another stop member is held within a respective mounting aperture upon application of rotating force to the rotatable member.

16. Apparatus for performing weight resistance exercise via manual rotation, the apparatus comprising:

a rotatable member mounted on an axle, the rotatable member being manually engageable for application of manual force to rotate the rotatable member around the axle;

a pair of cable stop members each connected to an end of a respective cable means which is interconnected to a weight means, the weight means through the cable means holding the stop members within a respective mounting aperture;

the rotatable member having a pair of retaining members, each retaining member receiving and retaining a respective stop member upon rotation of the rotatable member, the cable means being interconnected to the weight means such that rotation of the rotatable member is resisted by the weight means through the cable means upon application of manual rotating force to the axle; wherein the rotatable member has an initial stable position when manual force is not being applied to the rotatable member, the rotatable member being mounted on the apparatus such that both stop members are simultaneously received and retained within the retaining members when the rotatable member is in the initial stable position and wherein the stop members are each received within a respective mounting aperture when the rotatable member is in the initial stable position.

17. The apparatus of claim 16 wherein the rotatable member has a grooved circumferential surface for receiving one of the respective cable means upon rotation of the rotatable member.

18. Apparatus for performing weight resistance exercise via manual rotation, the apparatus comprising:

a rotatable member mounted on an axle, the rotatable member being manually engageable for application of manual force to rotate the rotatable member around the axle;

a pair of cable stop members each connected to an end of a respective cable means which is interconnected to a weight means, the weight means through the cable means holding the stop members within a respective mounting aperture;

the rotatable member having a pair of retaining members, each retaining member receiving and retaining a respective stop member upon rotation of the rotatable member, the cable means being interconnected to the weight means such that rotation of the rotatable member is resisted by the weight means through the cable means upon application of manual rotating force to the rotatable member; wherein the rotatable member is mounted such that one stop member is received and retained within a respective retaining member and another stop member is held within a respective mounting aperture stationarily connected to the apparatus upon application of rotating force to the axle; wherein the mounting apertures comprise a slot and the stop members comprise a rigid bar extending the length of the slot, the retaining members of the rotatable member being adapted to receive a respective bar with the bar being simultaneously received within a respective mounting aperture when the rotatable member is in the initial stable position.

* * * * *